US009560951B2

(12) United States Patent
Ramirez Moreno

(10) Patent No.: US 9,560,951 B2
(45) Date of Patent: Feb. 7, 2017

(54) MOP WRINGER MACHINE

(71) Applicant: SPRIMSOL LIMPIEZAS, S.L., Benalup-Casas Viejas, Cádiz (ES)

(72) Inventor: Jose Damian Ramirez Moreno, Cádiz (ES)

( * ) Notice: Subject to any disclaimer, the term of this patent is extended or adjusted under 35 U.S.C. 154(b) by 0 days.

(21) Appl. No.: 14/421,706

(22) PCT Filed: Aug. 13, 2013

(86) PCT No.: PCT/EP2013/002424

§ 371 (c)(1),
(2) Date: Feb. 13, 2015

(87) PCT Pub. No.: WO2014/032770

PCT Pub. Date: Mar. 6, 2014

(65) Prior Publication Data

US 2015/0230686 A1 Aug. 20, 2015

(30) Foreign Application Priority Data

Aug. 28, 2012 (EP) ..... 12380042

(51) Int. Cl.
*A47L 13/59* (2006.01)

(52) U.S. Cl.
CPC ..... *A47L 13/59* (2013.01)

(58) Field of Classification Search
CPC ..... A47L 13/59; A47L 13/58
USPC ..... 15/260–261
See application file for complete search history.

(56) References Cited

U.S. PATENT DOCUMENTS 5,720,073 A * 2/1998 Kamada ..... A47L 13/59 100/132
6,055,698 A * 5/2000 De Guzman ..... A47L 13/59 100/122
7,434,292 B2 * 10/2008 Ramirez Moreno ... A47L 13/60 100/160

FOREIGN PATENT DOCUMENTS

DE 20 2006 007491 U1 10/2006
EP 0 734 681 A1 10/1996
GB 672 873 A 5/1952

OTHER PUBLICATIONS

International Search Report for related international application PCT/EP2013/002424, mailed Oct. 16, 2013 (3pgs.).
Written Opinion for related international application PCT/EP2013/002424, mailed Oct. 16, 2013 (5 pgs.).
International Preliminry Report on Patentability regarding related case PCT/EP2013/002424, issued Mar. 3, 2015 (6 pgs).

* cited by examiner

*Primary Examiner* — Laura C Guidotti
(74) *Attorney, Agent, or Firm* — James B. Conte; Ladas & Parry LLP

(57) ABSTRACT

Mop wringer machine that incorporates the classic wringer basket (2), mounted as a floating basket on its frame or base (1), by means of springs, therefore when a pair of flaps (4) in the shape of U puts pressure on the mop, after this is entered into the wringer basket (2), this basket is capable of being moved downward in a springing motion, in order to absorb different pressures caused by mops (5) of different shapes and/or sizes.

6 Claims, 4 Drawing Sheets

MOP WRINGER MACHINE

SUBJECT MATTER OF THE INVENTION

This invention relates to a mop wringer machine for mops used for cleaning floors and for those intended to be fitted to the mouth of the bucket containing the cleaning solution.

The purpose of the invention is to achieve a machine able to wring out a wide range of mops of different shapes and sizes.

BACKGROUND TO THE INVENTION

There are different types of mop wringer mechanisms, both manually activated and motorised, all of which are functionally limited to a certain type of mop.

In European patent EP 1438919 an automatic mop wringer is described in which two rollers are the fundamental elements, one exclusively capable of moving rotating on its axis and the second capable, in turn, of tilting towards the first due to the effect of a cam, thus both rollers constitute a type of "clamp" through which the mop is extracted, resulting in wringing it out.

This solution, although it enables mops of different sizes and configurations to be wrung out, is only fully satisfactory for a certain type of mop, since with a mop of smaller dimensions, the wringing pressure is insufficient, particularly the smaller the mop is. Furthermore, the size of the mops is also limited with regards to larger mops due to the maximum distance between rollers which enables the complete rotation of the cam.

DESCRIPTION OF THE INVENTION

The machine proposed by the invention constitutes a technological advance in the field of mop wringing, by truly enabling its use with mops of different shapes and sizes, always with optimum performance, regardless of the type and size of the mop in question.

In order to do this the machine integrates the wringing basket, which is usually attached to the bucket or cleaning water container, but with the feature that the aforementioned basket, with the capacity to take any type of mop, is fitted onto the fixed structure of the machine as a floating basket, thus its working position depends on the characteristics of the mop. The basket rests on the machine frame by means of a set of springs, preferably four, springs that in any case shall yield as necessary in accordance with the different sizes and types of mops. These springs exert an upward pressure.

The mop, conveniently housed in the basket, is pressed against the springs by means of two flaps in the shape of U, operable by a motor using a set of reduction gears and cams which cause them to tilt, exerting the flaps a downward pressure, to press the mop against the bottom of the basket. The aforementioned cams, synchronised in their movement, are specifically designed to carry out an angular movement between pre-established margins with a limit switch which controls the motor by electronic circuit. There is a second limit switch which determines the maximum available pressure to the aforementioned flaps. As a safety measure, the electronic circuit is protected by a current limiter.

The aforementioned flaps are able to adopt two final positions: an open position in which they are positioned vertically at a maximum distance apart, and a closed position, in which they are situated horizontally as close together as possible. This is done to press the mop against the bottom of the basket, automatically adopting one of the positions in accordance with their tilting and the vertical movement of the whole machine onto which they are incorporated.

According to tradition, the motor is powered by a battery integrated into the machine itself and rechargeable within it.

DESCRIPTION OF THE DRAWINGS

To supplement the description which will be carried out below and in order to aid a better understanding of the characteristics of the invention, in accordance with an example of a preferred practical embodiment, a set of drawings is attached as an integral part of this description, in which the following has been represented, including but not limited to.

PREFERENTIAL EMBODIMENT OF THE INVENTION

Figure 4:
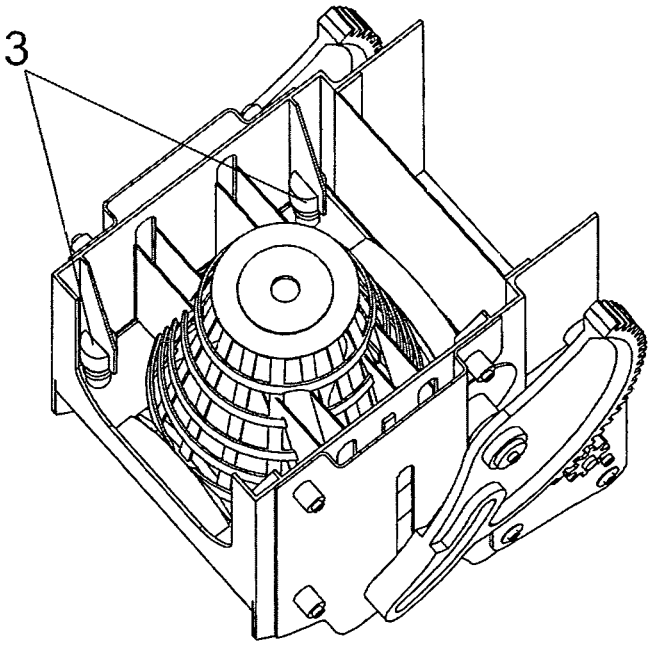
FIG. 4.—This shows a bottom plan of the machine in the previous figures.

In view of the aforementioned figures it can be seen how the mop wringer machine of the invention is structured using a frame or base (1), equipped with means for fitting the machine to the bucket or cleaning water container, the frame or base (1) on which the classic wringer basket (2) is mounted as a floating basket, but with the distinctive feature that this wringer basket (2) constitutes a floating element, i.e. it is capable of moving vertically, specifically against a set of springs (3), preferably four, particularly visible in FIG. 4, adapting the wringer basket's (2) position according to the particular needs of each type of mop to be wrung out.

The function of the springs (3) is to ensure that the same pressure is always exerted, regardless of the volume of the mop.

Figure 6:
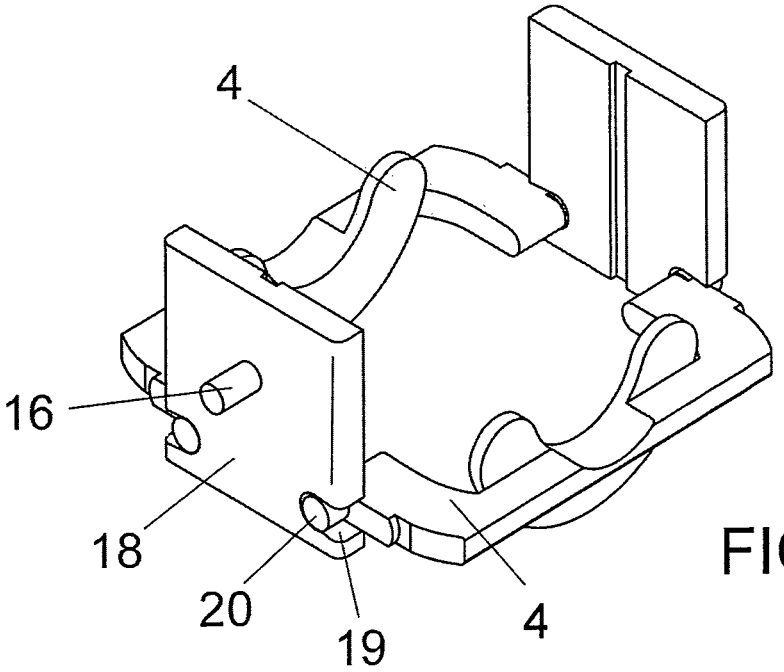
FIG. 6.—This shows a detailed view of the flaps, in an open or rest position.
Figure 7:
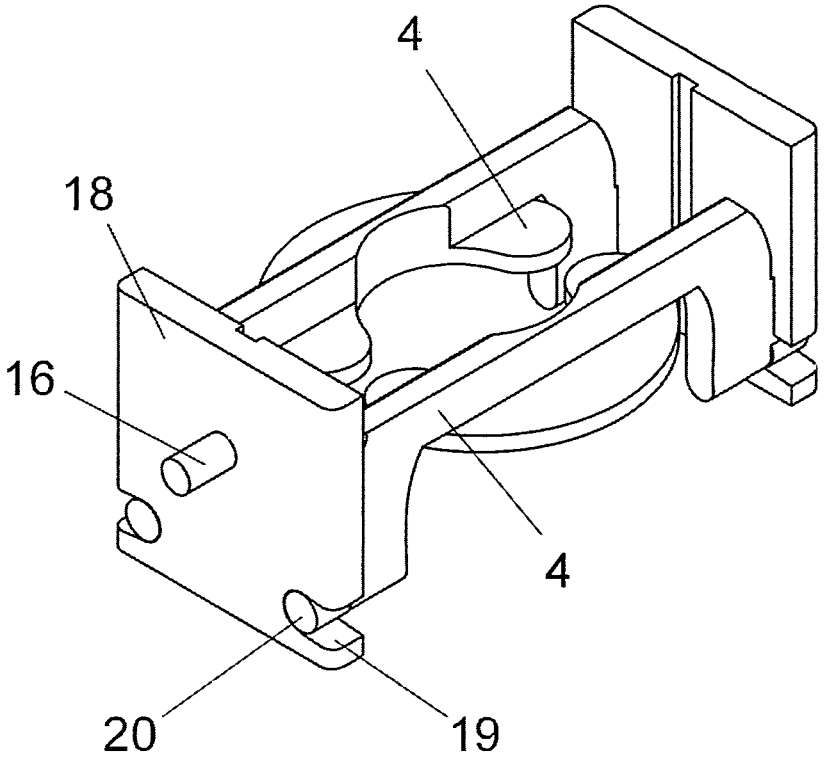
FIG. 7.—This shows, finally, the same detailed view of the previous figure, but this time with the flaps closed in the lower limit position.

The wringing out is undertaken with the collaboration of a pair of flaps (4) in the shape of U, located at the level of the basket mouth and able to be kept apart, as shown in FIG. 6, allowing the mop (5) to access the bottom of the wringer basket (2), and to be pushed down in order to put pressure on the upper part of the mop (5) and against the bottom of the basket, as observed in FIG. 7.

The flaps (4) are operated by an electric motor (6) powered by a battery (7) by means of an electronic board (8), a motor which, by means of a gear reduction box (9) moves the transverse axis (10), finished with pinion gears (11), with synched rotation, which act on the respective cams (12) with a toothed edge (13) and capable of effecting an angular movement on a pivot point (14), each cam having a grooved appendage (15), which constitutes the cam itself and on whose groove a pivot or ratchet (16) moves and which is moveable on a vertical slider or guide (17) which acts on the corresponding flap (4).

The flaps (4) are opposed in their downwards movement by the springs (3) located on the lower part of the basket.

According to the type of mop, the wringer basket (2) will be pressed downwards until it is in a certain position, the slider end (22) then acting to stop the electronic board (8) and returning to the rest position determined by the other slider end (23) the machine being left in a position in which it is ready for a new operation.

More specifically, the pivot or ratchet (16) is integrated onto the external face of a flat surface (18), equipped with corresponding notches (19) on its lateral edges and the lower part, which are open sideways, in which other ratchets (20) move, coaxially emerging from the flaps (4).

Thus, in the upper bound for this machine, as shown in FIG. 6, the flaps (4) move down in an outward direction due to gravity, adopting the maximum open position and a parallel and vertical position, enabling the mop (5) to be freely pushed towards the wringer basket (2), whilst when the downward movement of the machine occurs, due to the rotation of the cams (12) and consequent dragging of the pivots or ratchets (16), the flaps (4) flip down towards the closing position, which is shown in FIG. 7, in which the flaps (4) are horizontally positioned adjusting to the edge of the mop head and wringing it out perfectly.

Figure 1:
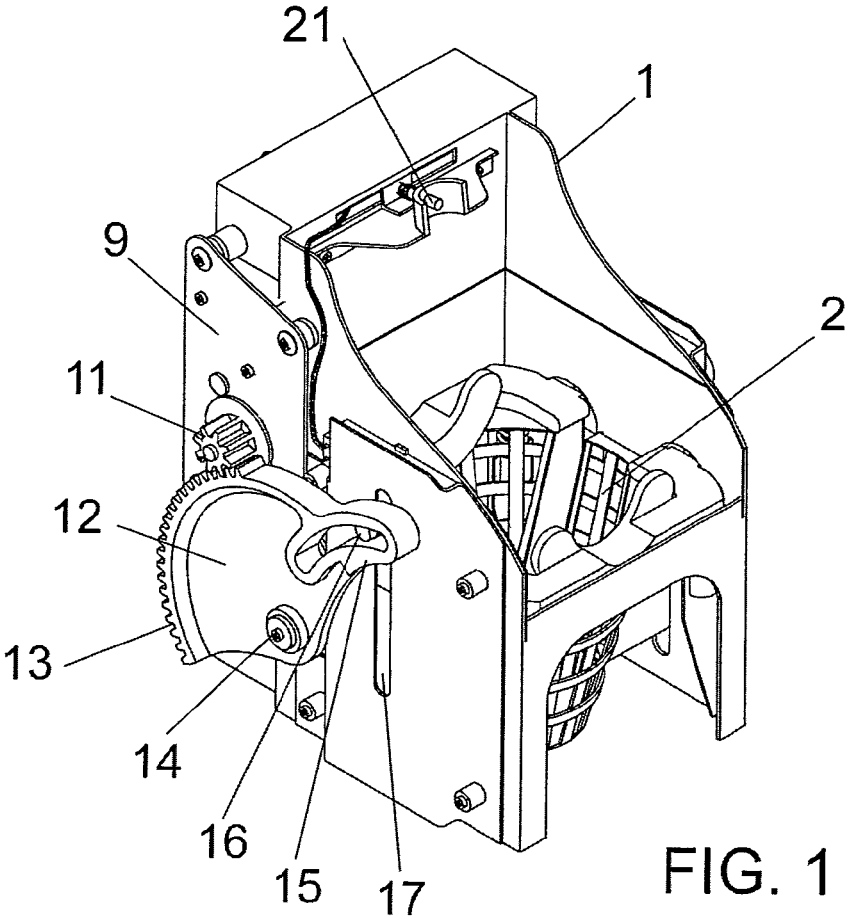
FIG. 1.—This shows, according to a general view, a mop wringer machine manufactured in accordance with the purpose of this invention.
Figure 2:
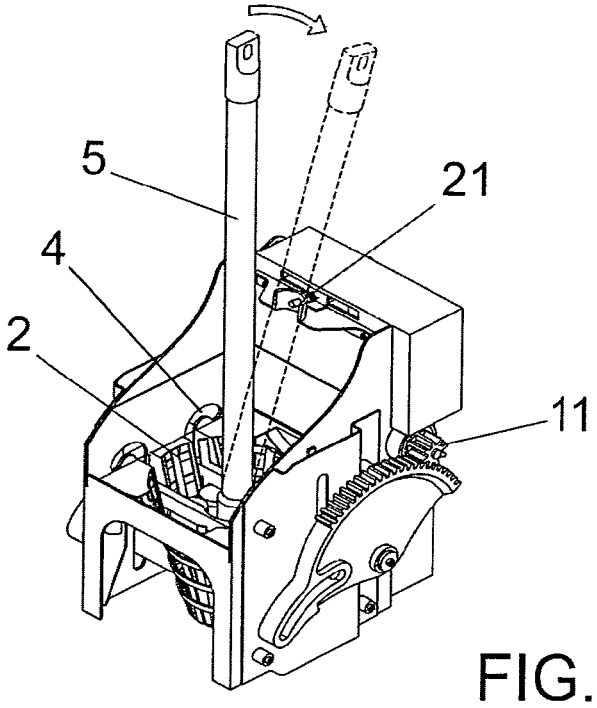
FIG. 2.—This shows another view of the same machine, after the mop to be wrung out has been attached thereto.
Figure 3:
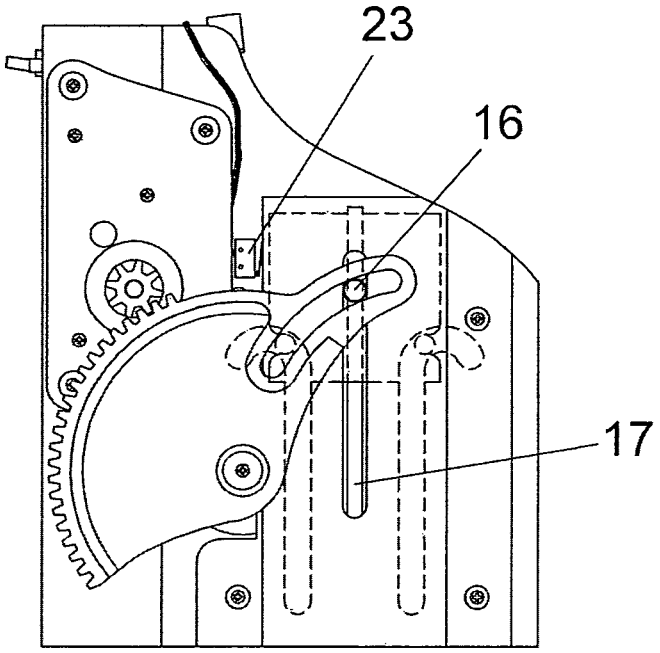
FIG. 3.—This shows a side view of the same machine.
Figure 5:
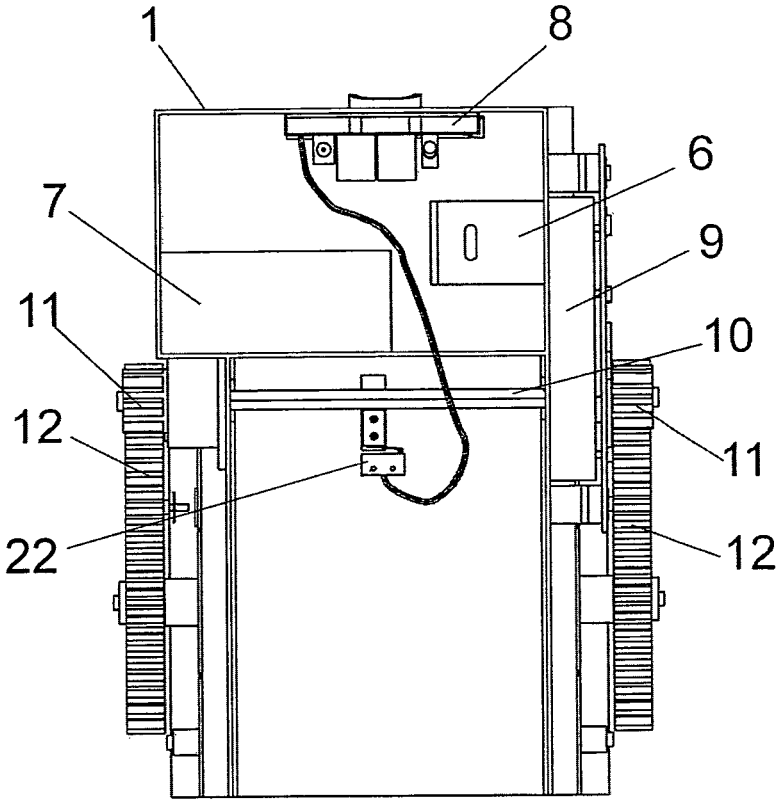
FIG. 5.—This shows a view of the rear part of the aforementioned machine.

A button (21) operates the machine when the mop (5) handle is pressed against it, as demonstrated by the dotted line in FIG. 2, closing the electric motor (6) power circuit, which makes the flaps (4) flip down against the wringer basket (2) and moving the latter downwards, to the point indicated to this end, determined by a slider end (22) particularly visible in FIG. 5, whilst a second slider end (23) causes the electric motor (6) to stop after each operating cycle of the machine.

The invention claimed is:

1. A mop wringer machine comprising:

pressure devices in the form of a pair of tilting flaps in a shape of a U, said flaps adjustable to a top position wherein the flaps are at a maximum distance separating them and adjustable to a bottom position wherein the flaps are at a minimum distance separating them;

an electric motor coupled to the pressure devices, a frame or base coupled to the pressure devices a floating basket supported by the frame or base by springs, wherein elastic deformation of the springs enables the basket to move downwards when the pressure devices require it in accordance with a size and shape of a mop.

2. A mop wringer machine, according to claim 1, wherein the electric motor, with a gear reduction box, transmits movement to a transverse axis finished by respective pinion gears on its ends, which interlock with a toothed section of respective cams fitted with a grooved appendage on which a pivot or ratchet moves attached to a flat surface, the pivot or ratchet moving along a vertical slider or guide.

3. A mop wringer machine, according to claim 2, wherein the pivot or ratchet each have two lateral, lower notches on which the respective ratchet or pivot move.

4. A mop wringer machine, according to claim 3, wherein the electric motor is powered by a battery by means of an electronic board with the collaboration of two slider ends, one which limits a descent of the wringer basket, and another which determines an operating cycle of the machine, as well as a button which starts the cycle and is operable by a mop handle.

5. A mop wringer machine, according to claim 2, wherein the electric motor is powered by a battery by means of an electronic board with the collaboration of two slider ends, one which limits a descent of the wringer basket, and another which determines an operating cycle of the machine, as well as a button which starts the cycle and is operable by a mop handle.

6. A mop wringer machine, according to claim 1, wherein the electric motor is powered by a battery by means of an electronic board with the collaboration of two slider ends, one which limits a of the wringer basket, and another which determines an operating cycle of the machine, as well as a button which starts the cycle and is operable by a mop handle.

* * * * *